US008567765B1

(12) United States Patent
Miller

(10) Patent No.: US 8,567,765 B1
(45) Date of Patent: Oct. 29, 2013

(54) WELL PUMP EXTRACTOR

(76) Inventor: Joseph Dennis Miller, North Fort Myers, FL (US)

( * ) Notice: Subject to any disclaimer, the term of this patent is extended or adjusted under 35 U.S.C. 154(b) by 0 days.

(21) Appl. No.: 13/506,652

(22) Filed: May 7, 2012

(51) Int. Cl.
*B21F 9/00* (2006.01)
*B66F 3/00* (2006.01)

(52) U.S. Cl.
USPC ..... 254/227; 254/134.3 R; 254/213; 254/223

(58) Field of Classification Search
USPC ..... 254/134.3 R, 134.5, 213, 217, 225, 227, 254/243, 223; 166/385, 77.1, 68
See application file for complete search history.

(56) References Cited

U.S. PATENT DOCUMENTS

| | | | | |
|---|---|---|---|---|
| 1,403,962 | A | 1/1922 | Jolly | |
| 3,185,399 | A | 5/1965 | Pelliociotti | |
| 3,190,616 | A | 6/1965 | Oleson | |
| 3,690,409 | A * | 9/1972 | Brauss | 182/142 |
| 3,719,238 | A | 3/1973 | Campbell et al. | |
| 3,741,525 | A | 6/1973 | Smedley | |
| 3,847,501 | A | 11/1974 | Doty | |
| 3,871,618 | A | 3/1975 | Funk | |
| 3,902,751 | A | 9/1975 | Burkepile et al. | |
| 3,934,647 | A | 1/1976 | Bokenkamp | |
| 3,968,952 | A | 7/1976 | Newell | |
| 3,991,978 | A | 11/1976 | Jones | |
| 4,188,997 | A | 2/1980 | Ainsworth | |
| 4,191,514 | A | 3/1980 | Ely | |
| 4,196,864 | A | 4/1980 | Cole | |
| 4,270,734 | A | 6/1981 | Straight | |
| 4,296,916 | A | 10/1981 | Jewett | |
| 4,384,636 | A | 5/1983 | Hillemacher | |
| 4,899,816 | A | 2/1990 | Mine | |
| 5,145,283 | A | 9/1992 | Gowen | |
| 5,149,056 | A | 9/1992 | Jones | |
| 5,188,177 | A | 2/1993 | Curry | |
| 5,246,068 | A | 9/1993 | Besson | |
| 5,511,614 | A | 4/1996 | Jennings | |
| 5,653,293 | A | 8/1997 | Ellis | |
| 5,848,641 | A | 12/1998 | Epp | |
| 5,984,273 | A | 11/1999 | Ray | |
| 5,996,971 | A | 12/1999 | Crouse | |
| 6,158,516 | A | 12/2000 | Smith et al. | |
| 6,361,021 | B1 | 3/2002 | Brennan | |
| 6,378,844 | B1 | 4/2002 | Weaver | |
| 6,769,669 | B2 | 8/2004 | Cook et al. | |
| 6,904,660 | B2 | 6/2005 | English | |
| 6,966,543 | B2 * | 11/2005 | Loudamy | 254/243 |
| 7,128,499 | B2 | 10/2006 | Wentworth | |
| 7,226,040 | B2 * | 6/2007 | Keister | 254/324 |
| 7,712,726 | B1 | 5/2010 | Jernigan | |
| 7,987,570 | B2 * | 8/2011 | Salazar et al. | 29/244 |
| 2004/0239076 | A1 * | 12/2004 | McCoy et al. | 280/495 |
| 2006/0273291 | A1 | 12/2006 | Roodenburg et al. | |
| 2007/0089884 | A1 | 4/2007 | Patton | |
| 2009/0183351 | A1 | 7/2009 | Buttz | |

* cited by examiner

*Primary Examiner* — Emmanuel M Marcelo
*Assistant Examiner* — Angela Caligiuri
(74) *Attorney, Agent, or Firm* — George F. Wallace

(57) ABSTRACT

A well pump extractor, which includes a base rotably supporting a spindle, a pipe guide, and a pipe catch, extracts a well pump from within a well by winding electrical wiring attached to the pump around the spindle. During an extraction, a pipe guide guides the path of water pipe connected to a pump. If the electrical wiring fails mechanically during an extraction, the pipe catch catches the water pipe, which prevents the pump from falling to the bottom of the well.

30 Claims, 3 Drawing Sheets

FIG. 3
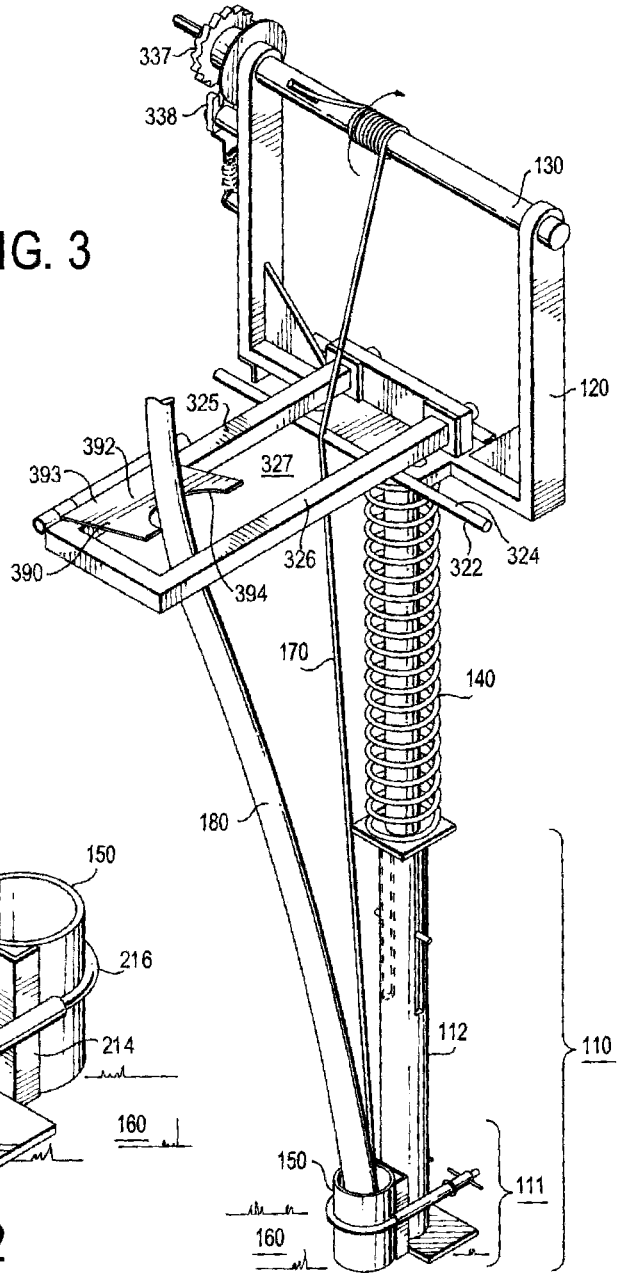
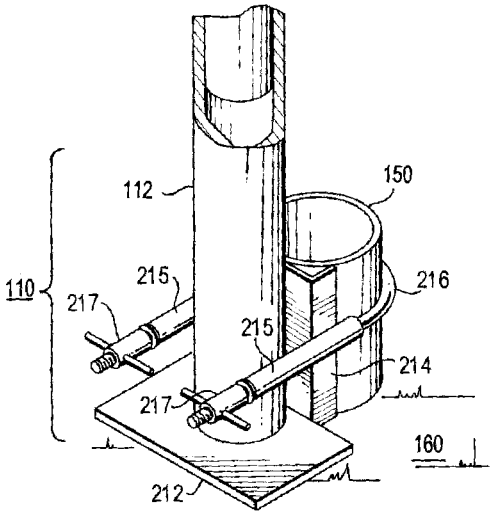
FIG. 2

WELL PUMP EXTRACTOR

CROSS-REFERENCE TO RELATED DOCUMENTS

This disclosure is related to and incorporates by reference in its entirety, co-pending U.S. patent application Ser. No. 13/506,651 entitled "Well Pump Puller," filed by Joseph Dennis Miller on May 7, 2012.

BACKGROUND OF THE INVENTION

Wells are constructed to access subsurface water for various purposes, such as for drinking and irrigation. Electric well pumps ("well pumps") are utilized to pump subsurface water up to the surface. Typical well configurations include a well casing that extends from the ground surface (which include points above the ground surface) to a point below the subsurface water, with a well pump being disposed within the casing. Typical structure connected to such pumps and extending to the ground surface include a water pipe, which often includes multiple connected segments, for carrying the subsurface water, and electrical wiring for providing electrical current to such pumps.

A well pump can fail for various reasons. Therefore, well pumps can require replacement, which requires a failed well pump to be extracted from within a well.

A prior solution is provided in U.S. Pat. No. 3,741,525 by Smedley ("Smedley"), which discloses a well puller that pulls a well pump via a permanent high-tensile strength cable. As disclosed, this solution includes a well application that necessarily requires the addition of a permanent high-tensile strength lifting cable, and expressly teaches away from pulling a plastic water pipe, as "it lacks the strength to sustain the tensile forces resulting when the pump and seal are pulled from the well." A significant drawback with the Smedley solution is that prior provisioning of such a permanent high-tensile strength lifting cable is required for this solution to be effectuated.

Another prior solution is the "Pull-a-Pump", which is a well pump puller having motorized means that can extract a well pump by pulling a water pipe connected to a pump. Specifically, this solution includes a pair of motorized, opposing traction belts between which a well pipe is gripped and moved upwardly. As the belts move, the pipe and pump are lifted from within a well casing.

SUMMARY OF THE INVENTION

It is, therefore, an object of the present invention to provide a well pump puller.

It is another object of the present invention to provide a well pump puller that can allow a well pump to be extracted from within a well by pulling pre-existing electrical wiring connected to the pump while concurrently reducing the risk of the well pump falling into the well.

The present invention reduces this risk by reducing yank forces on the wiring and/or by providing a pipe catch adapted to catch and hold a water pipe connected to a well pump if the electrical wiring mechanically fails during an extraction of the well pump.

An exemplary environment of the present invention can include a well pump disposed within a well casing that extends from a ground surface point (which includes points just above the ground surface) to a below-ground point. Electrical wiring can have a first wiring end connected to the well pump and a second wiring end extending up to the ground surface point; and a water pipe can have a first pipe end connected to the well pump and a second pipe end extending up to the ground surface point.

In an exemplary embodiment of the present invention, a well pump puller for extracting a well pump from within a well casing can include a rigid base, a rigid support element, and an elastic element.

In an exemplary aspect, a rigid base can include an engagement element and a base extension. An engagement element can be adapted to engage the well casing and/or the ground surface. A base extension can extend upwardly from the ground surface point.

In another exemplary aspect, a rigid support element can be moveably engaged with the base extension; and can rotatably support a spindle. A spindle can have a rotation element for rotating the spindle, and can be adapted to fixably receive a second wiring end of the electrical wiring.

In a further exemplary aspect, an elastic element can be disposed between, and abut, the base and the support element during a well pump extraction.

In yet another exemplary aspect, when the second wiring end is fixably received by the spindle and the rotation element is rotated, the electrical wiring can be wound around the spindle resulting in a pulling force applied to the electrical wiring, which pulls the well pump and the water pipe from within the well casing towards the ground surface. During such an extraction, the elastic element can deform to absorb at least a portion of any yank forces arising at least in part from the pulling force.

The following are optional exemplary aspects, of which one or more can be combined with the basic invention as embodied above:

- the spindle can include a spindle lock and a safety latch to prevent the spindle from rotating in one of a clockwise direction and a counter-clockwise direction, and to allow the spindle to rotate in the other of the clockwise direction and the counter-clockwise direction;
- the base or the support element can include a wire guide disposed between the spindle and the well casing, where the wire guide includes a rounded edge against which the electrical wiring slides before the electrical wiring is wound around the spindle;
- the base or the support element can include a rigid pipe guide having at least one frame element that defines an opening, disposed over the well casing, and having a size greater than the water pipe, and as the well pump and water pipe are pulled out from within the well casing, the water pipe travels through the opening;
- in addition to a pipe guide, the base or support element can include a pipe catch having at least one rigid flap, adjacent to the opening, and having a first flap end hingedly connected to the pipe guide and a second flap end having a concave shape, the at least one flap being, biased in a locking position, and moveable between an unlocking position, in which the second flap end is angled upwardly, and the locking position, in which the at least one flap covers a portion of the opening;
- the base or support element can include a drill abutment adapted to abut at least one of the right and left side of a drill; and
- the drill abutment can be rotatably moveable between a stored position and an active position.

In another exemplary embodiment of the present invention, a well pump puller for extracting a well pump from within a well casing can include a rigid base, a rigid pipe guide, and a pipe catch.

The following are exemplary aspects of this embodiment: a rigid base can include an engagement element and a base extension; an engagement element can be adapted to engage the well casing and/or the ground surface; a base extension can extend upwardly from the ground surface point and can rotatably support a spindle; and a spindle can have a rotation element for rotating the spindle, and can be adapted to fixably receive a second wiring end of the electrical wiring.

Further exemplary aspects of the embodiment are as follows: a rigid pipe guide can be connected to the base and can have at least one frame element that defines an opening, disposed above the well casing, and having a size greater than the water pipe; a pipe catch can include at least one rigid flap, adjacent to the opening, and having a first flap end hingedly connected to the pipe guide and a second flap end having a concave shape; and the at least one flap can be, biased in a locking position, and moveable between an unlocking position, in which a respective second flap end is angled upwardly, and the locking position, in which the at least one flap covers a portion of the opening.

Additional exemplary aspects of this embodiment are as follows: when the second wiring end is fixably received by the spindle and the rotation element is rotated, the electrical wiring can be wound around the spindle resulting in a pulling force applied to the electrical wiring, which pulls the well pump and the water pipe from within the well casing towards the spindle, with the water pipe being guided through the opening with the at least one flap being in the unlocked position; and if the water pipe is subsequently moved downwardly after being guided upwardly through the opening, the second flap end locks the water pipe in a static position by abutting the water pipe and creating static friction in conjunction with at least one of the at least one frame element and a second rigid flap.

Further, this exemplary embodiment can include any one or more of the basic and optional exemplary aspects described above and/or herein.

These and other exemplary aspects of the present invention are described herein.

BRIEF DESCRIPTION OF THE DRAWINGS

The present invention is illustrated by way of example, and not in limitation, in the figures of the accompanying drawings, in which:

FIG. 2 illustrates a detailed view of an exemplary engagement element that can engage a ground surface and/or a well casing.

FIG. 3 illustrates an exemplary embodiment of the present invention additionally having optional components of a pipe guide, a pipe catch, a wire guide, a spindle lock, and a safety latch.

DETAILED DESCRIPTION OF THE INVENTION

Figure 1:
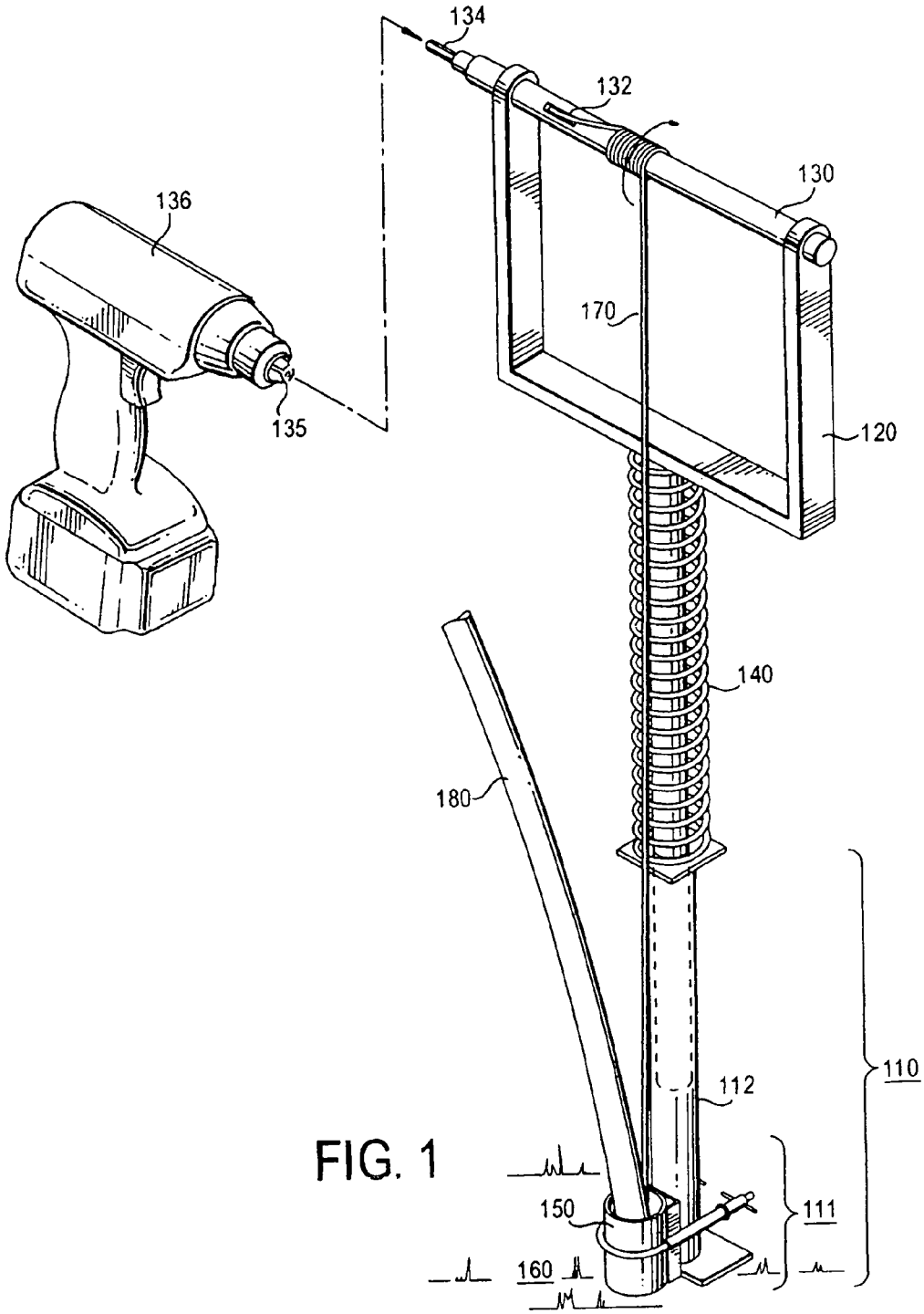
FIG. 1 illustrates an exemplary embodiment of the present invention having a base, a support element rotatably supporting a spindle, and an elastic element.

The invention will now be described in more detail by way of example with reference to the embodiments shown in the accompanying figures. It should be kept in mind that the following described embodiments are only presented by way of example and should not be construed as limiting the inventive concept to any particular physical configuration, material, or order.

As noted above, installed well pumps can require replacement due to their failure, and accordingly, can require extraction from within wells. When extracting a well pump from within a well, there is a risk that the well pump can fall to the bottom of the well due to human or mechanical error. Manually extracting a well pump can be exceedingly tedious, especially when well depths are great, as such extracting can involve pulling the water pipe up by hand or motor until the well pump reaches the surface. While some wells may only require depths of 50 feet or less, some can require depths exceeding 450 feet to reach subsurface water (e.g., an aquifer). However, extracting a well pump that has fallen to the bottom of a well due to a failed extraction can be significantly more tedious, expensive, and time-consuming. Thus, recovering a fallen well pump can be extremely difficult and costly.

The pulling force required to pull a well pump from within a well to the ground surface must be sufficient to overcome weight considerations and resistive forces arising during an extraction of the well pump.

Exemplary weight considerations can include the following: a typical residential well pump can weigh about 30 pounds; water pipe (typically, 1.25" PVC Schedule 40) can weigh about 0.43 pounds/foot; water within a water pipe weighs 8 pounds/gallon; and electrical wiring can weigh about 0.075 pounds/foot. Given these weight considerations, it is feasible for the total weight of such combinations to exceed 230 pounds for a 200 foot well and 430 pounds for a 400 foot well.

Exemplary physical forces existing during an extraction of a well pump can arise due to the following: drag forces that can arise from moving the water pump through subsurface water existing within the well casing above the well pump; and kinetic friction that can arise from mineral build-up on the well pump and/or inner walls of a well casing sliding against each other or against the well pump and/or inner walls.

When extracting a well pump by pulling it via electrical wiring connected thereto, there exists a risk that well pump can fall into the well due to the electrical wiring mechanically failing (or breaking). Such mechanical failure can arise if the pulling force, by itself or in combination with other conditions, creates an amount of strain on the electrical wiring that exceeds the effective tensile strength of the electrical wiring:

$$\text{Mechanical Failure} = Fp > TSe,$$

where $F_p$ is the pulling force, and $TS_e$ is the effective tensile strength of the wiring.

Two significant problems exacerbate this risk: yank forces, and mechanical defects of the electrical wiring.

Yank forces can arise, for example, from variability of the pulling force and/or variability of resistive forces. A yank force can be expressed as the derivative of force with respect to time, and can be represented as follows:

$$Y = dF/dT, \text{ where}$$

Y is the yank force,

F is the pulling force on the wiring, and d/dT is the derivative with respect to time t.

Notably, a drag force can be expressed as follows:

$$F_D = \tfrac{1}{2}\rho v^2 C_D A, \text{ where}$$

$F_p$ is the drag force, which is by definition the force component in the direction of the flow velocity, ρ is the mass density of the subsurface water, ν is the velocity of the object relative to the subsurface water, A is the reference area, and $C_D$ is the drag coefficient.

Motorized and manual generation of a pulling force can provide a variable pulling force that may exceed the tensile strength of the wiring. For example, the generated pulling force applied to the electrical wiring to move the well pump from a static position can exceed the tensile strength of the electrical wiring, especially when the pulling force is increased or applied too quickly. Moreover, variability in the generation of the pulling force can arise due to human interaction or error, such as, for example and not in limitation, manual generation of the pulling force, manual operation of a motor (e.g., the triggering a variable speed drill), or between manual "pulls" generated by hand. Notably, a pulling force, by itself or in combination with drag forces and/or friction, applied too quickly can generate a problematic yank force.

Further, variability of resistive forces can arise as a pulling force is applied to electrical wiring. For example, where mineral build-up on the well pump housing and/or inner walls of the well casing exist, the sudden generation of static, even if temporary, resistive forces, while a pulling force is being applied, can arise, which can significantly increase the strain on the electrical wiring due to the addition of a yank force. Moreover, drag forces can increase relative to the speed at which the well pump is pulled.

Mechanical defects of the electrical wiring can significantly reduce the effective tensile strength of the wiring. Typical electrical wiring utilized in subsurface well pump applications can include various gauges, such as, for example and not in limitation, 14 American Wire Gauge (AWG) Stranded Wiring. For example, a 14 AWG Stranded Wiring can have a production-defined breaking strength between 128 lbs and 349 lbs. However, in practice, the effective breaking strength of electrical wiring can be less than production-defined strengths due to production defects, in-field wiring damage, and/or environmental conditions, such as wiring deterioration, environmental temperature, sulfur exposure, and long-term temperature fluctuations, for example and not in limitation, all of which may not be readily apparent when a well pump is initially installed, or when a well pump is subsequently extracted. Where the effective breaking strength of electrical wiring is significantly reduced, the risk of electrical wiring failing mechanically during the extraction of a well pump can be undesirably high.

Therefore, the present invention can be embodied in a well pump puller that can reduce the risk of a well pump falling into a well when extracting the well pump via its electrical wiring by reducing the mechanical strain on the electrical wiring from yank forces and/or by securably fixing the pipe in a static position if the electrical wiring fails during such an extraction.

Initially, it should be noted the present invention can be designed or otherwise built from any one or more materials, including but not limited to any type of metal, plastic, ceramic, naturally occurring, synthetic, or man-made material or materials, as long as the final product can functionally operate as described. Thus, use of the word "rigid" is intended to mean overall rigidness, such that effective functionality as described and claimed is achieved.

FIG. 1 illustrates a basic exemplary embodiment of the present invention, in which a well pump puller can include a base 110; a support element 120 rotatably supporting a spindle 130; and an elastic element 140 disposed between the base and the support element. As further illustrated in FIG. 1, base 110 can include an engagement element 111, and a base extension 112 that extends upwardly.

Referring now to FIG. 2, an engagement element can include a ground engager 212 and/or a casing engager (see infra) A ground engager 212 can be provided with a flat shape for abutment with the ground 160 and to support base 210. As further illustrated in FIG. 2, casing engager can include a vertically-oriented channel 214, a pair of bolt sleeves 215, and a u-bolt 216 having a pair of wing nuts 217. As illustrated, channel 214 can be disposed against a well casing 150, with u-bolt 216 being disposed around the casing and through bolt sleeves 215. Wing nuts 217 can then be engaged with u-bolt 216 and tightened to engage base 110 to well casing 150, which provides support for the base.

Notably, an engagement element according to the present invention is not necessarily limited to the specific exemplary aspects and structures illustrated above. For example and not in limitation, engagement element can include any compatible structure to engage well casing 150 and/or the ground 160 adjacent thereto, such as one or more clamps, hose clamps, ratchet clamps, straps, cables, brackets, bolts, nuts, feet, bases, or any other known or apparent structure(s) able to engage well casing 150. Further, an engagement element can be provided as a hollowed cylindrical flange having an outside diameter less than an inner diameter of well casing 150, such that the flange can fit within the well casing with base 110 abutting the top of the casing. Such configuration can provide both vertical and horizontal support for base 110.

FIG. 1 also illustrates an exemplary well pump puller during an exemplary extraction of a well pump (not shown). Initially, an exemplary well pump puller can be positioned adjacent to an exemplary well casing 150. When an exemplary puller is so positioned, and engagement element can be engaged with the ground surface 160 and/or well casing 150; a first end of pre-existing electrical wiring 170 can be connected to a well pump (not shown) disposed within the well casing; and a second end of wiring 170 can be fixably received by spindle 130. As illustrated, in one exemplary manner, a second end can be fixed to spindle 130 via optional notch 132 in which the second end can be fixably wedged. Notably, however, fixation can alternatively or conjunctively be effectuated in any other desired manner, such as wrapping wiring 170 around spindle 130 and over itself to create static friction; tying wiring 170 around spindle 130 in a knot or friction-conducive configuration; or wrapping and/or tying wiring 170 around a pin or other protrusion or depression (not shown) provided with spindle 130.

After wiring 170 is fixably received by spindle 130, rotation element 134 can be rotated, which rotates spindle 130. In an exemplary aspect, rotation element 134 can be rotated by hand or motor, and illustratively, can be provided as one or more of a crank, a crank handle, a gear, a sprocket, a shank, or any other structural element that allows direct or indirect application of a rotational force to rotation element 134, which transfers such force to spindle 130. As illustrated in FIG. 1, rotation element can be provided as a shank 134 for connection to a chuck 135 of an electric drill 136, for example and not in limitation. In this example, rotation of rotation element 134 can be effectuated by activating drill 136, which rotates spindle 130.

As electrical wiring 170 is wound around spindle 130 due to its rotation, a pulling force is generated on the wiring, which pulls the wiring up from within the well casing 150 and towards spindle 130. As wiring 170 is pulled up, a target well pump, as well as a water pipe 180 connected to the pump, can also be pulled upwardly from within well casing 150. When the pump reaches the ground surface 160, the well pump can then be accessed manually and subsequently discarded or repaired.

As illustrated in FIG. 1, to reduce the force-effect of yank forces on electrical wiring 170 during extraction of a well pump, elastic element 140 can be disposed between base 110 and support element 120. As further illustrated in FIG. 1, base extension 112 can have a hollowed portion, and a portion of support element 120 can be adapted to slidably move therein. Accordingly, in this particular embodiment, a yank force that arises during an extraction can be at least partially transferred to a downward motion of support element 120 and then to a deformation of elastic element 140. Thus, the risk of a yank force causing the strain on electrical wiring 170 during an extraction to exceed the breaking strength of the wiring can be reduced by transferring the yank force, at least in part, to elastic element 140, which in this embodiment deforms via compression. It should be noted that deformation of elastic element 140 can alternatively or conjunctively be by stretching, bending, twisting, and/or any other form of deformation consistent with the present invention.

Notably, according to the present invention, base extension 112 need not have a hollowed portion, and support element 120 can include a hollowed portion, such that support element 120 can be adapted to move downwardly and around base extension 112. Further, while the exemplary configuration of FIG. 1 illustrates base extension 112 and the engaging portion of support element 120 as being cylindrical, they need only be shaped in a manner complementary to each other, such that movable engagement between base extension 112 and support element 120 can be achieved to transfer yank forces to elastic element 140. Further, complementary shapes need only be functionally compatible and need not be adapted such that one must necessarily fit in or around another, such as when one engages another along a side, for example and not in limitation. Further, moveable engagement can additionally include movement such as leaning, for example and not in limitation, such as where support element 120 and base extension 112 are connected to elastic element 140, and the support element can bend towards an arising yank force, with elastic element deforming to accommodate such leaning.

Further, exemplary cross-sectional shapes of support element 120 and base extension 112 are not limited to round shapes, as illustrated in FIG. 1, but can be oval, square, triangular, hexagonal, oblong, or any other symmetric or asymmetrical shape, including partial or whole variations thereof.

In an exemplary aspect of the present invention, elastic element 140 is illustratively shown as a spring 140 in FIG. 1, but can be provided as any one or more elastic structures, materials, and/or systems adapted to at least partially absorb a yank force via deformation, such as compression and/or stretching, such as, for example and not in limitation, any one or more of any type of shock, strut, spring, torsion bar, or dampener.

Thus, elastic element 140 can include, in whole or in part, any one or more, and/or any known or apparent combinations and variations of, an elastic material, elastic band, elastic cord, elastic bushing, spring, torsion bar, hydraulic shock, pneumatic shock, magnetic shock, spring shock, hydropneumatic shock, tension spring, extension spring, compression spring, torsion spring, constant spring, variable spring, coil spring, flat spring, machined spring, cantilever spring, helical spring, conical spring, volute spring, hairspring, balance spring, leaf spring, v-spring, Belleville spring, constant-force spring, gas spring, ideal spring, mainspring, negator spring, progressive rate coil spring, spring washer, and/or wave spring.

Further, elastic element 140 can be shaped cylindrically, as illustratively shown in FIG. 1, but can be provided in any other functionally compatible shape consistent with the present invention, including but not limited to, a sphere, a cube, a parallelogram, a cylinder, a pyramid, an oblong shape, a conical shape, a barrel shape, a convex shape, a concave shape, or any other symmetric and/or asymmetric shape.

Figure 4:
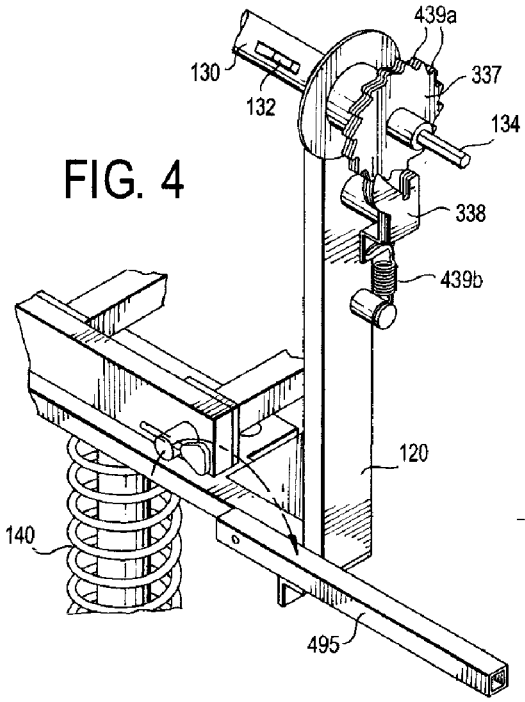
FIG. 4 illustrates an exemplary embodiment of the present invention additionally having optional components of a spindle lock, safety latch, and a pipe abutment.

FIGS. 3 and 4 illustrate exemplary optional aspects of the present invention, one or more of which can be combined with the basic invention as described above.

As illustrated in FIG. 3, spindle 130 can optionally include a spindle lock 337 and a safety latch 338, which can cooperatively prevent the spindle from rotating in at least one of a clockwise direction and a counter-clockwise direction. As illustrated in FIG. 4, spindle lock 337 can include a plurality of teeth 439*a*, and can be connected to spindle 130 such that the lock and spindle rotate together. As further illustrated in FIG. 4, safety latch 338 can be pivoted to a locked position, such that it engages at least one of teeth 439*a*, in which latch 338 can abut at least one of teeth 439*a*, which prevents spindle lock 337 (and accordingly, spindle 130) from rotating in one or both directions. Further, safety latch 338 can be pivoted to an unlocked position, such that it is disengaged from teeth 439*a*, which allows spindle lock 337 (and accordingly, spindle 130) to rotate freely.

Optionally, safety latch 338 can be spring-biased towards a locking position via spring mechanism 439*b*. Additionally, teeth 439*a* can optionally be angled in one of a clockwise and counterclockwise direction, such that when safety latch 338 is in a locked position, spindle lock 337 can be rotated in the other of the clockwise and counterclockwise direction, with safety latch 338 being adapted to pivot away from teeth 439*a* and slide over teeth 439*a*, and further being biased to reset in a locked position after the other the clockwise and counterclockwise rotation stops.

As also illustrated in FIG. 3, support element 120 can include a wire guide 322 that can be positioned between spindle 130 and well casing 150. Wire guide 322 can include a rounded edge 324 against which electrical wiring 170 can slide before being wound around spindle 130, which can allow wiring 170 to self-distribute itself along spindle 130. Notably, wire guide 322 is illustratively shown to be connected to support element 120, but alternatively or conjunctively can be connected to base 110.

FIG. 3 also illustratively shows an optional pipe guide 325 for guiding water pipe 180 directionally during a well pump extraction. Pipe guide 325 can have at least one frame element 326 that defines an opening 327, which can be positioned between well casing 150 and spindle 130, and can be sized greater than water pipe 180. Accordingly, as electrical wiring 170 is pulled from well casing 150 towards spindle 130, water pipe 180 can be directed through opening 327, which guides the water pipe via frame element 326, which provides an abutment function.

Notably, pipe guide 325 is illustratively shown to be connected to support element 120, but alternatively or conjunctively can be connected to base 110. Further, frame element 326 is illustrated as having a U-shape, but can be provided in alternative shapes, in whole or in part, such as a whole or partial circle, square, rectangle, oval, oblong shape, or any other symmetric or asymmetric shape that provides abutment-based guidance of water pipe 180 during a well pump extraction.

As further illustrated in FIG. 3, support element 120 can optionally include a pipe catch 390 having at least one rigid flap 392 adjacent to opening 327. A flap 392 can include a first flap end 393 hingedly connected to pipe guide 325, and a second flap end 394 having a concave shape. A flap 392 can be biased, via a spring or gravity, towards a locking position, in which second end 394 of flap 392 covers at least a portion of opening 327, such that the effective size of opening 327 is smaller than water pipe 180. From such a position, a flap 392 can hinge upwardly towards spindle 130, so as to be in an unlocking position, and second end 394 sufficiently exposes opening 327 such that water pipe 180 can move upwardly through the opening. Accordingly, during an extraction, water pipe 180 can be disposed within opening 327, and a second end 394 of flap 392 can be angled upwardly (or towards spindle 130), such that water pipe 180 can move upwardly through the opening as electrical wiring 170 is wound around spindle 130. In the event water pipe 180 is thereafter moved downwardly, second end 394 of flap 392, in conjunction with pipe guide 325 and/or a second flap (not shown), can lock the water pipe in a static position by abutting the water pipe and creating static friction therewith. Thus, if electrical wiring 170 mechanically fails during an extraction, pipe catch 390 can prevent a well pump from falling by locking the water pipe 180, which is connected to the well pump, in a static position. Notably, a second end 394 of a flap 392 can include an acute, right, or obtuse angled edge.

Referring now to FIG. 4, as illustrated, support element 120 can optionally include a drill abutment 495 adapted to abut at least one of the right and left side of a drill (not shown). Accordingly, when a drill is utilized to rotate rotation element 134, drill abutment 495 can abut the left or right side of the drill, which will depend on the direction in which the drill is rotating. As further illustrated, drill abutment 495 can be connected so as to swivel between an active position and a stored position. Notably, drill abutment 495 is illustratively shown to be connected to support element 120, but alternatively can be connected to base 110.

Figure 5:
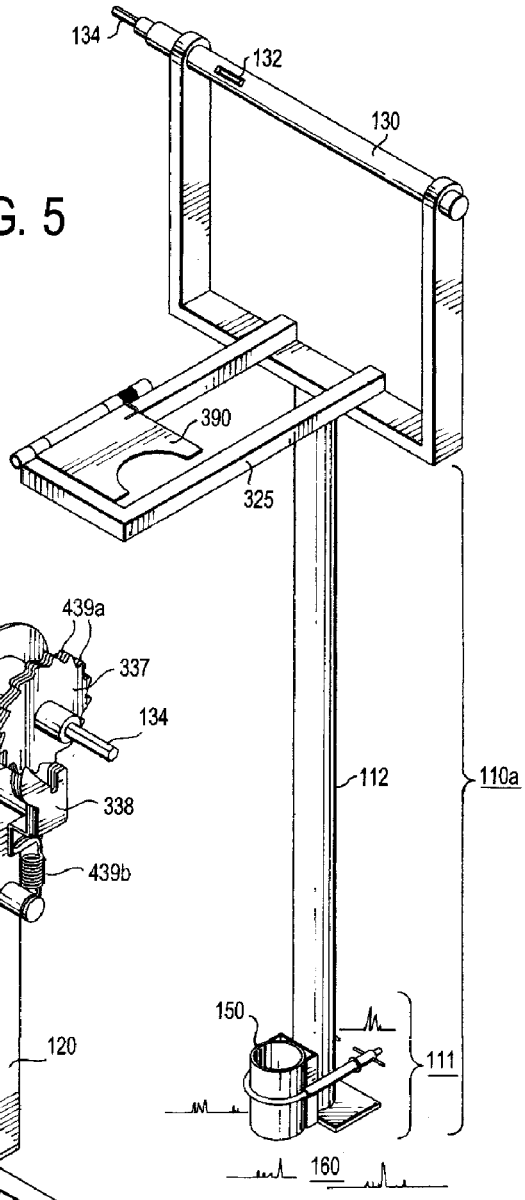
FIG. 5 illustrates another exemplary embodiment of the present invention having a base, a base extension rotatable supporting a spindle, a pipe guide, and a pipe catch.

Reference is now made to FIG. 5, which illustrates another embodiment of the present invention, in which a well pump puller for extracting a well pump from within a well casing can include a rigid base 110*a*, a pipe guide 325, and a pipe catch 390. Notably, the exemplary aspects of this embodiment generally mirror those described above, except base 110*a* is defined to encompass the support element, as this embodiment lacks an elastic element in its broadest form.

As illustrated, base 110*a* can include an engagement element 111 adapted to engage a well casing 150 and/or the ground surface 160, and a base extension 112, extending upwardly, and rotatably supporting a spindle 130 having a rotation element 134 and an optional notch 132. Notably, this exemplary embodiment can include any one or more of the basic and optional aspects herein described in connection with any other exemplary embodiment of the present invention, with the same functioning similarly or the same.

It will be apparent to one of ordinary skill in the art that the manner of making and using the claimed invention has been adequately disclosed in the above-written description of the exemplary embodiments and aspects. It should be understood, however, that the invention is not necessarily limited to the specific embodiments, aspects, arrangement, and components shown and described above, but may be susceptible to numerous variations within the scope of the invention. Moreover, particular exemplary features described herein in conjunction with specific embodiments and/or aspects of the present invention are to be construed as applicable to any embodiment described within, enabled hereby, or apparent herefrom. Thus, the specification and drawings are to be regarded in a broad, illustrative, and enabling sense, rather than a restrictive one.

Further, it will be understood that the above description of the embodiments of the present invention are susceptible to various modifications, changes, and adaptations, and the same are intended to be comprehended within the meaning and range of equivalents of the appended claims.

I claim:

1. A well pump puller for extracting a well pump from within a well casing that extends from a ground surface to a below-ground point, the well pump having, electrical wiring with a first wiring end connected to the well pump and a second wiring end extending up to the ground surface, and a water pipe with a first pipe end connected to the well pump and a second pipe end extending up to the ground surface, the well pump puller comprising:

a rigid base having an engagement element adapted to engage at least one of the well casing and the ground surface, and a base extension extending upwardly, and rotatably supporting a spindle having a rotation element for rotating the spindle, the spindle being adapted to fixably receive the second wiring end;

a rigid pipe guide, connected to said base, and having at least one frame element defining an opening, disposed above the well casing, and having a size greater than the water pipe; and a pipe catch having at least one rigid flap, adjacent to the opening, and having a first flap end hingedly connected to said pipe guide and a second flap end having a concave shape, the at least one flap being, biased in a locking position, and moveable between an unlocking position, in which a the respective second flap end is angled upwardly, and the locking position, in which the at least one flap covers a portion of the opening;

wherein when the second wiring end is fixably received by the spindle and the rotation element is rotated to rotate the spindle, the electrical wiring is wound around the spindle resulting in a pulling force applied to the electrical wiring, which pulls the water pipe and the pump from within the well casing towards the ground surface, and the water pipe is guided upwardly through the opening with the at least one flap being in the unlocked position, and if the water pipe is subsequently moved downwardly, the second flap end locks the water pipe in a static position by abutting the water pipe and creating static friction in conjunction with at least one of the at least one frame element and a second rigid flap.

2. The puller of claim 1, wherein the engagement element includes a ground engager adapted to abut the ground surface.

3. The puller of claim 2, wherein the engagement element further includes a casing engager adapted to secure said base to the well casing.

4. The puller of claim 3, wherein one of said base and the casing engager includes a securing element, connected to said base, and defining a pair of bolt holes, and the casing engager includes a u-bolt having a pair of threaded ends and nuts, the ends being adapted to respectively pass through the bolt holes with the well casing disposed between the u-bolt and the holes, and the nuts being adapted to respectively engage the ends to secure said base against the well casing.

5. The puller of claim 1, wherein the engagement element includes a casing engager adapted to secure said base to the well casing.

6. The puller of claim 5, wherein one of said base and the casing engager includes a securing element, connected to said base, and defining a pair of bolt holes, and the casing engager includes a u-bolt having a pair of threaded ends and nuts, the ends being adapted to respectively pass through the bolt holes with the well casing disposed between the u-bolt and the holes, and the nuts being adapted to respectively engage the ends to secure said base against the well casing.

7. The puller of claim 1, wherein the base extension includes a hollow portion, and a section of said support element is adapted to slide within the hollow portion while deforming said elastic element.

8. The puller of claim 1, wherein the spindle is cylindrical.

9. The puller of claim 1, wherein the spindle includes a cylindrical portion.

10. The puller of claim 1, wherein the rotation element includes a crank handle adapted to rotate the spindle.

11. The puller of claim 1, wherein the rotation element includes a shank adapted to operably connect to a chuck of a drill.

12. The puller of claim 1, wherein the rotation element includes an electric motor adapted to rotate the spindle.

13. The puller of claim 1, wherein the spindle includes a notch within which the second wiring end is fixable.

14. The puller of claim 1, wherein the spindle is adapted to fixably receive the second wiring end by winding the electrical wiring around the spindle and over the second wiring end.

15. The puller of claim 1, wherein the spindle includes a spindle lock, having a plurality of teeth, and being adapted to revolve with the spindle, and a safety latch being spring-biased to engage at least one of said plurality of teeth so as to prevent the spindle from rotating in one of a clockwise direction and a counter-clockwise direction, and to allow the spindle to rotate in the other of the clockwise direction and the counter-clockwise direction.

16. The puller of claim 15, wherein the plurality of teeth are angled towards the one of a clockwise direction and a counter-clockwise direction.

17. The puller of claim 1, wherein said base includes a wire guide, disposed between the spindle and the well casing, and having a rounded edge against which the electrical wiring slides as the electrical wiring is wound around the spindle.

18. The puller of claim 1, wherein one or more of the at least one frame element has a curved shape.

19. The puller of claim 1, wherein one or more of the at least one frame element is straight.

20. The puller of claim 1, wherein the rigid pipe guide includes a plurality of frame elements defining the opening.

21. The puller of claim 20, wherein one or more of the plurality of frame elements is straight.

22. The puller of claim 20, wherein one or more of the plurality of frame elements has a curved shape.

23. The puller of claim 1, wherein the at least one flap is spring biased towards the locking position.

24. The puller of claim 1, wherein the at least one flap is gravity biased towards the locking position.

25. The puller of claim 1, wherein the pipe catch includes the second rigid flap.

26. The puller of claim 25, wherein the at least one flap is spring biased towards the locking position.

27. The puller of claim 25, wherein the at least one flap is gravity biased towards the locking position.

28. The puller of claim 25, wherein the at least one flap is biased towards being coplanar with the ground surface.

29. The puller of claim 1, wherein said base includes a drill abutment adapted to abut at least one of a right side and a left side of a drill.

30. The puller of claim 29, wherein the drill abutment is rotatably moveable between a stored position and an active position.

* * * * *